US006394753B1

(12) United States Patent
Maki et al.

(10) Patent No.: US 6,394,753 B1
(45) Date of Patent: May 28, 2002

(54) FLEXIBLE IMPELLER REMOVAL AND INSTALLATION METHOD

(75) Inventors: Bruce A. Maki, Hugo; Dan A. Beilke, Roseville; Jeffrey W. Bona, Moundsview, all of MN (US)

(73) Assignee: Hypro Corporation, Saint Paul, MN (US)

( * ) Notice: Subject to any disclaimer, the term of this patent is extended or adjusted under 35 U.S.C. 154(b) by 0 days.

(21) Appl. No.: 09/779,108

(22) Filed: Feb. 7, 2001

(51) Int. Cl.[7] ..... F03B 11/00

(52) U.S. Cl. ..... 416/146 R; 416/244 R; 29/267

(58) Field of Search ..... 416/146 R, 244 R, 416/245 A, 240, 132 R; 29/245, 253, 267, 268

(56) References Cited

U.S. PATENT DOCUMENTS

| | | | | |
|---|---|---|---|---|
| 1,824,033 A | | 9/1931 | Brenneman et al. | |
| 1,895,448 A | | 1/1933 | Cornwell et al. | |
| 1,953,297 A | | 4/1934 | Good | 416/244 R |
| 2,916,813 A | | 12/1959 | Belanger | |
| 3,058,207 A | | 10/1962 | Wilson | |
| 4,538,962 A | | 9/1985 | McCain | 416/146 R |
| 5,152,044 A | * | 10/1992 | Bales | 29/257 |
| 5,341,553 A | | 8/1994 | Herzhauser | |
| 6,116,855 A | | 9/2000 | Maki | 416/146 R |
| 6,213,740 B1 | * | 4/2001 | Barnes | 418/2 |

FOREIGN PATENT DOCUMENTS

| | | | | |
|---|---|---|---|---|
| JP | 257248 | * | 9/1999 | E04C/5/00 |

* cited by examiner

*Primary Examiner*—John E. Ryznic
(74) *Attorney, Agent, or Firm*—Nikolai & Mersereau, P.A.

(57) ABSTRACT

Flexible vane pumps (also referred to as rubber impeller pumps) are commonly used in the marine engine coolant market. Replacement of the flexible (rubber) impeller has proven to be difficult, particularly for larger pumps located in the confines of an engine compartment of a boat and for impellers encrusted with salt, sand or otherwise stuck to the pump shaft. To aid in extracting impellers, an end piece on the impeller has been added such that a tool having flanges can be inserted into a space between the end piece and the impeller. The end piece on the impeller can also be used as an end plate to engage a threaded shaft for jacking the impeller onto a pump shaft. An alignment cone can be added to the pump housing for aligning the impeller with the pump shaft and pump housing bore.

11 Claims, 6 Drawing Sheets

FLEXIBLE IMPELLER REMOVAL AND INSTALLATION METHOD

BACKGROUND OF THE INVENTION

1. Field of the Invention

This invention relates to impellers and particularly to an impeller having an end piece on an insert to aid in installation and removal of flexible impellers from pump housings.

2. Description of the Related Art

Flexible impellers are installed on a shaft in pump housings. The fit of the impeller into the pump must be with some squeeze of the blades. This arises from the cam. It provides the displacement of the impeller. In addition the need to provide some degree of initial impeller compression is necessary to account for slip. Thus the installation of such an impeller is with a fair amount of force to overcome the deflection of the blades while simultaneously pushing or pulling the impeller into the pump. In the case of installation the impeller must be inserted with a twisting motion to align the impeller insert with the key, spline or other drive mechanism located on the shaft. When removing an impeller the problem is compounded in that some means must be found to initially grip the impeller to pull it, as the impeller is flush with the housing. Most often an impeller is removed because it is worn and has been in the housing for some period of time. Flexible (rubber) impeller pumps are extensively used in the marine industry as raw water coolant pumps on small boats. Often used impellers will be encrusted with silt and salt. This makes the initial pull from the pump more difficult. The difficulty increases dramatically with larger impellers and is compounded with the physical restrictions often imposed by the location of pumps in confined engine compartments of boats.

A number of methods have evolved over the years to remove impellers from pumps. A simple technique is to use two pair of pliers. Two impeller blades are gripped on either side using the pliers. They are then pulled out. For a tough impeller two screwdrivers can be used to pry the impeller from a stuck position.

For large impellers or impellers stuck on a shaft the above techniques can prove to be inadequate. This forces the user to either remove the pump from the location and work on impeller removal from a workbench, or to use an alternate method of impeller removal. Removing the pump from the engine is not always practical. An example of such a situation is changing a failed impeller while a boat is at sea. One removal tool used works very much like a bearing-puller. To grip the hub of the impeller through a screw mechanism and then the impeller is pulled off the shaft by another screw pushing against the pump shaft. Although this tool is effective it is expensive and usually found only in the professional mechanics toolbox.

An alternate method used is to provide for a thread on one end of the insert of the rubber impeller. A bolt or screw is threaded into the treaded end of the insert. It is screwed in until it pushes against the shaft and jacks the hub or impeller from the bore. This is a technique used for removing blower hubs and other such hubs that have either a tight fit or may become jammed on a shaft over time. Although it has proven to be an effective technique there are two disadvantages to it. In marine applications where the impeller is in salt water the thread can become corroded. This can prevent the method from working. In addition the need to tap the end of the impeller insert adds cost to the manufacture of the rubber impeller.

SUMMARY OF THE INVENTION

The invention comprises an insert for a flexible (rubber) impeller designed to be used with an inexpensive removal tool. The insert has a drive mechanism built into the bore such as a spline, keyway, flat or other mechanism. The insert also has an internal bore and an end piece with one or two flanges or ears at one end. The ears have a step to allow for a stop.

The insert has external lugs axially to provide a mechanical grip to the rubber after molding.

The impeller insert, when installed on a shaft in a pump, will have clearance between the two ears and the end of the shaft, or in a second embodiment between one ear and the end of the shaft.

A special tool can be used to engage the impeller by being inserted and locked through a twisting action into the ear or between the ears at the end of the impeller.

The tool is used to pull the impeller from the housing. The tool is of a special design that allows a stuck or tight impeller to be initially freed from the housing by rocking the tool.

An alternate tool is also provided for difficult impeller removal. By the use of a screw mechanism in the tool a difficult impeller can be jack screwed from the pump.

In another embodiment a tapped hole is provided in the pump shaft for purpose of impeller installation. A special installation tool is placed through the impeller. The tool with the impeller is threaded into the hole. The impeller is then forced into the hole by turning the installation tool drive nut forcing the insert onto the pump shaft by pressing on the ear.

An additional installation tool consists of an, alignment cone. When placed in front of an open pump it allows the flexible impeller to be forced to the shape of the housing as it is pushed through the cone.

OBJECTS OF THE INVENTION

It is an object of the invention to provide for easily installing the flexible impeller on a shaft in a pump housing.

It is an object of the invention to provide for easily removing the flexible impeller from a shaft in a pump housing.

It is an object of the invention to provide an ear on the end of the impeller insert for use with a tool for removing and installing the impeller insert on a pump shaft.

It is an object of the invention to provide a tool for twisting or rocking the insert on the pump shaft to loosen it.

It is an object of the invention to provide a tool with a handle for twisting or pulling the impeller insert from the pump shaft.

It is an object of the invention to provide a tool with a leverage slot for pulling the impeller insert from the pump shaft.

It is an object of the invention to provide a tool with a screw jack for pulling the impeller insert from the pump shaft.

It is an object of the invention to provide a tool with a screw jack for installing the impeller insert from the pump shaft.

It is an object of the invention to provide an alignment cone for installing the impeller insert from the pump shaft.

It is an object of the invention to provide a flexible impeller installation and removal method that provides for an inexpensive tool and methodology for installing and removing flexible impellers in pumps.

Other objects, advantages and novel features of the present invention will become apparent from the following detailed description of the invention when considered in conjunction with the accompanying drawing.

DESCRIPTION OF THE PREFERRED EMBODIMENTS

Figure 1:
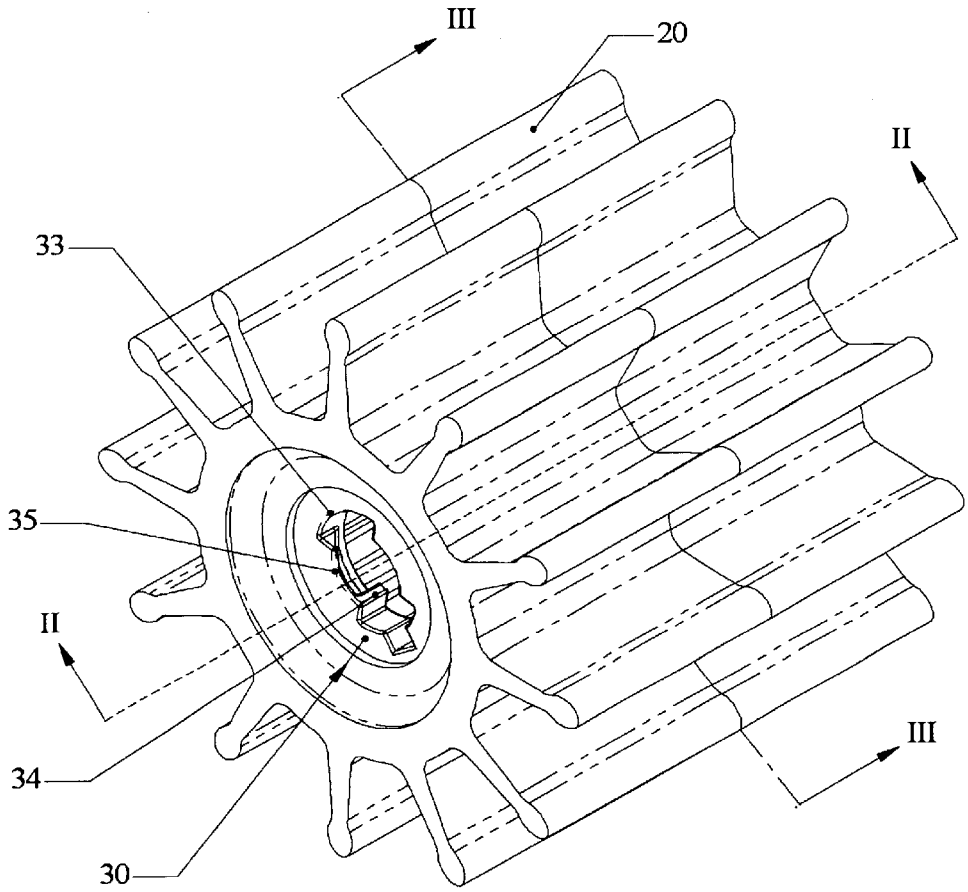
FIG. 1 is a perspective view of a rubber impeller.
Figure 2:
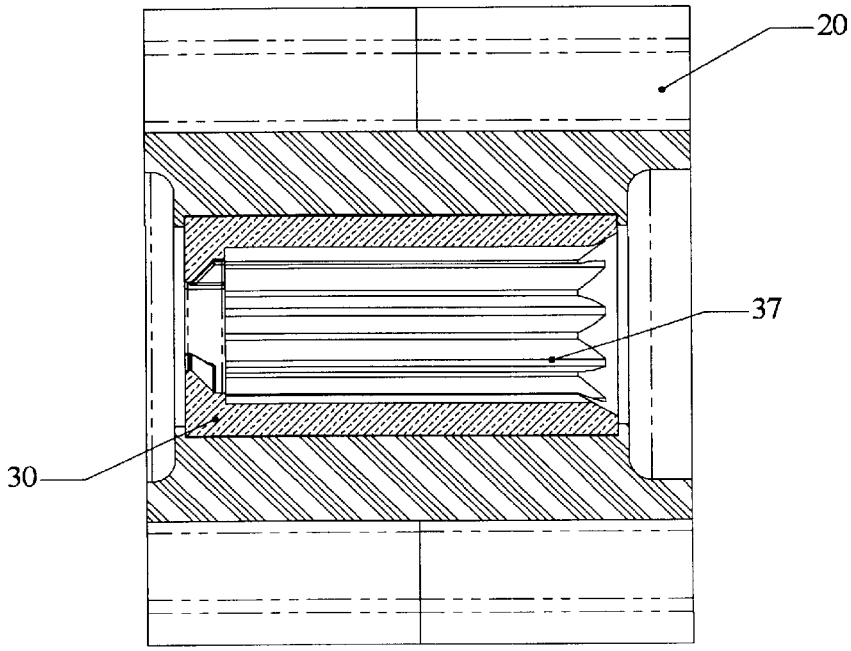
FIG. 2 is a cross sectional view taken alone line II in FIG. 1.
Figure 3:
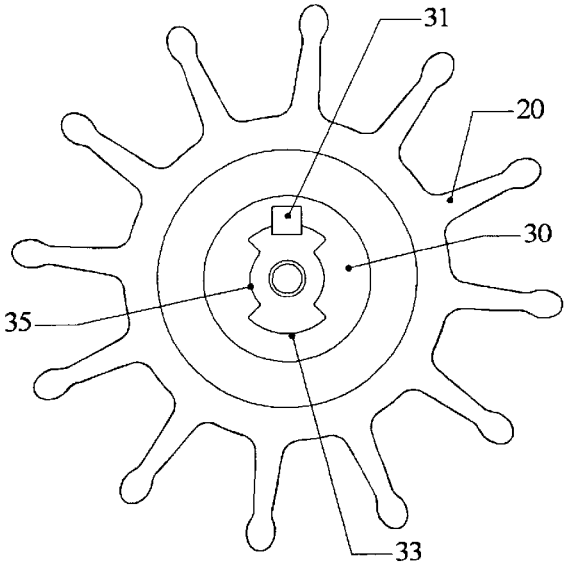
FIG. 3 is an end view of the rubber impeller.
Figure 4:
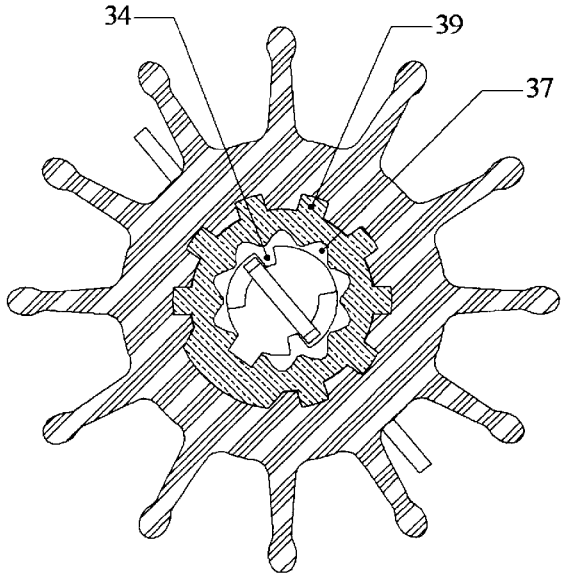
FIG. 4 is a cross sectional view taken along line III—III in FIG. 1.
Figure 5:
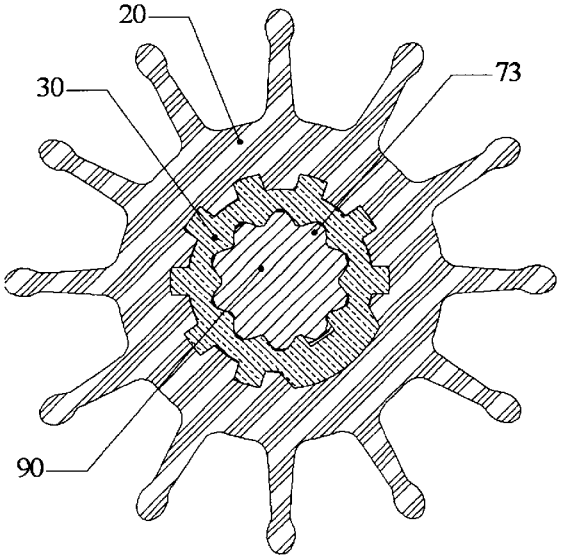
FIG. 5 is a cross sectional views of FIG. 4 with a splined shaft.
Figure 6:
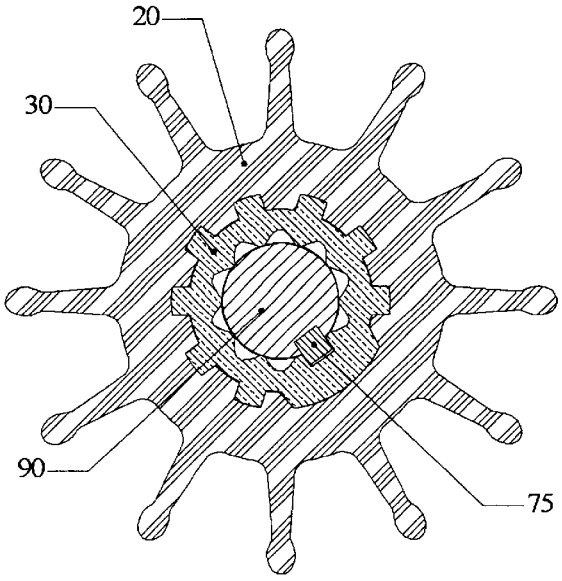
FIG. 6 is a cross sectional views of FIG. 4 with a keyed shaft.
Figure 7:
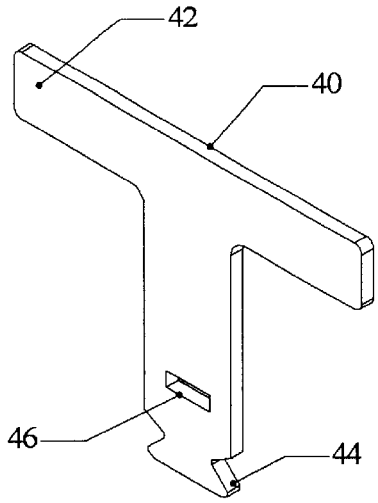
FIG. 7 is a prospective view of a removal tool.
Figure 8:
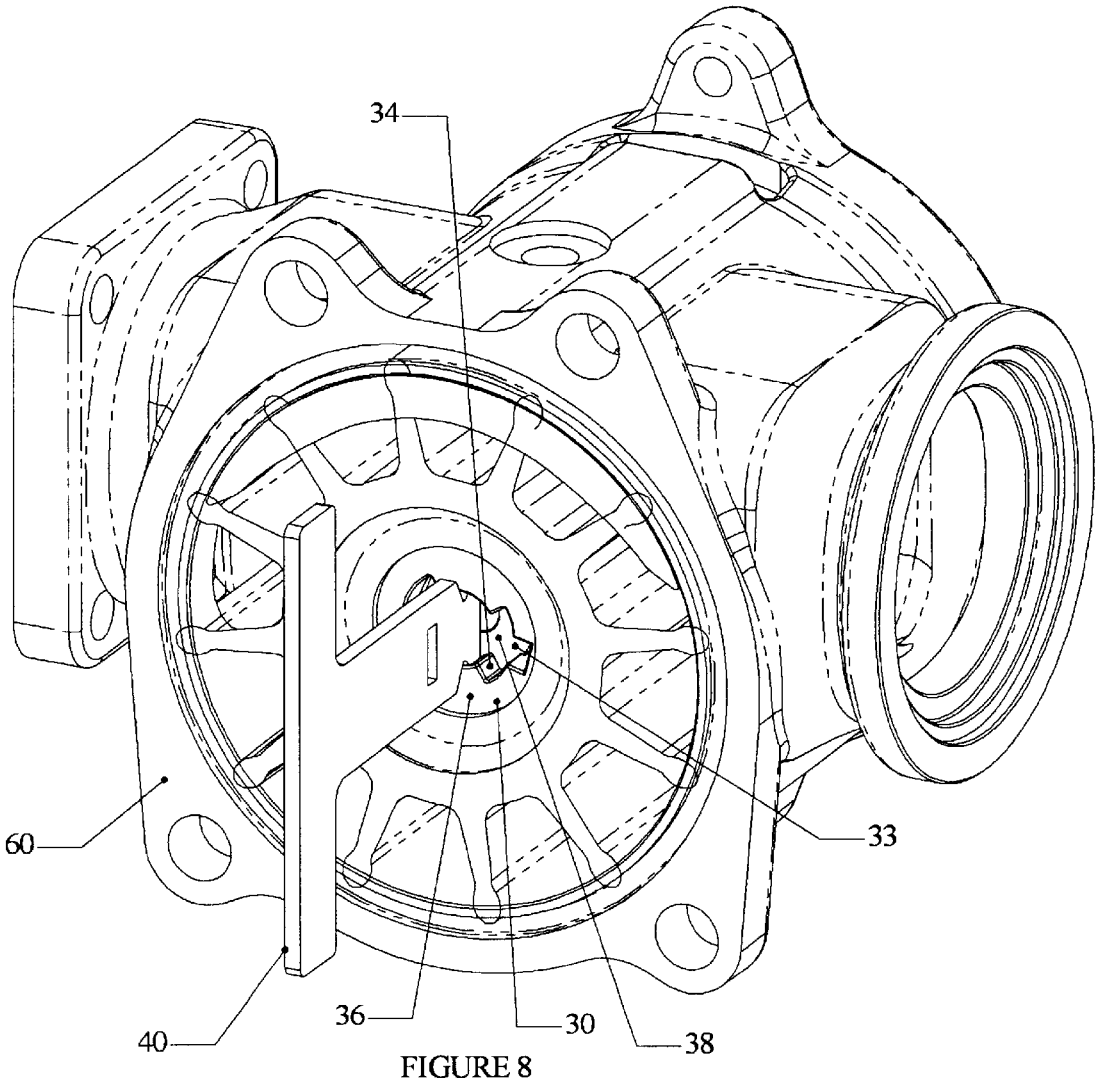
FIG. 8 is a perspective view of the removal tool inserted in an impeller in a pump.

FIG. 1 shows a first embodiment of a flexible (rubber) impeller 20 with the special designed impeller insert 30 according to the present invention. The impeller insert 30 is shown in further detail in FIGS. 2, 3, 4, 5, and 6. The features of the impeller insert 30 include the removal lugs 35, the combination internal spline 37 and keyway drive 31 and the external drive lugs 39. FIG. 7 shows the major features of the removal tool 40 which include the handle 42, the screwdriver lever slot 46, and the engagement flanges 44. FIG. 8 shows the function of the removal tool 40. After the pump cover plate is removed the removal tool 40 is inserted into the end of the impeller,insert 30 through the two slots 33. Once the removal tool 40 is inserted into slots 33 it is turned ninety degrees until the engagement flanges 44 contact the two stops 34 on the impeller insert 30 or alternately on the end piece 32. The removal tool 40 is unique in that it provides three methods to assist in removing the impeller insert 30 from the pump shaft 90 in the pump housing 60. If the impeller insert 30 is not stuck in the pump shaft 90 it may be simply pulled out. If the impeller insert 30 needs to be loosened prior to pulling it from the pump shaft 90 in the pump housing 60 the removal tool 40 can be rocked back and forth placing a force on the impeller insert 30 to loosen it on the pump shaft 90 in the pump housing 60. The engagement flanges 44 act as a lever to move the impeller insert 30 some distance off the pump shaft 90 and free it from any binding. For a particularly stubborn impeller 20 a screwdriver can be inserted into the slot 46 in the removal tool 40. Then it can be pried against the pump housing 60 to aid in forcing the impeller 20 from the pump housing 60. The removal tool 40 is simple to manufacture and inexpensive as it can be made from a stamping.

Figure 9:
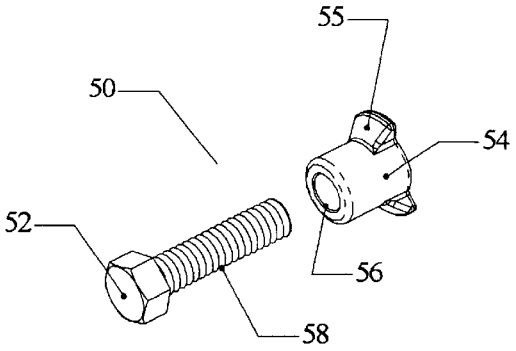
FIG. 9 is a perspective view of an alternative removal tool.
Figure 10:
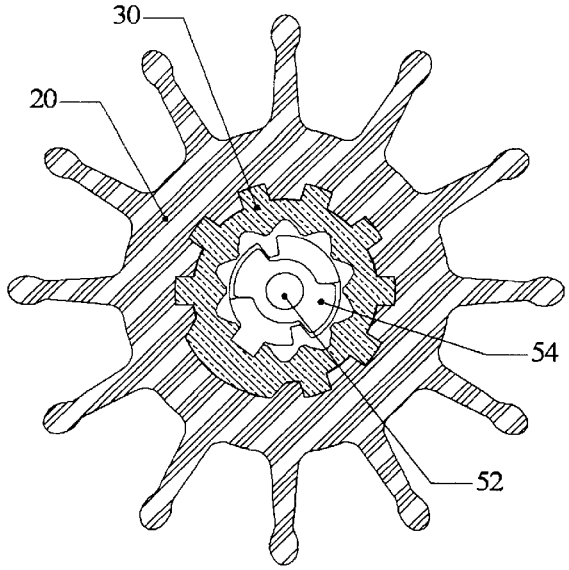
FIG. 10 is a cross sectional view along III—III with the alternative removal tool installed.
Figure 11:
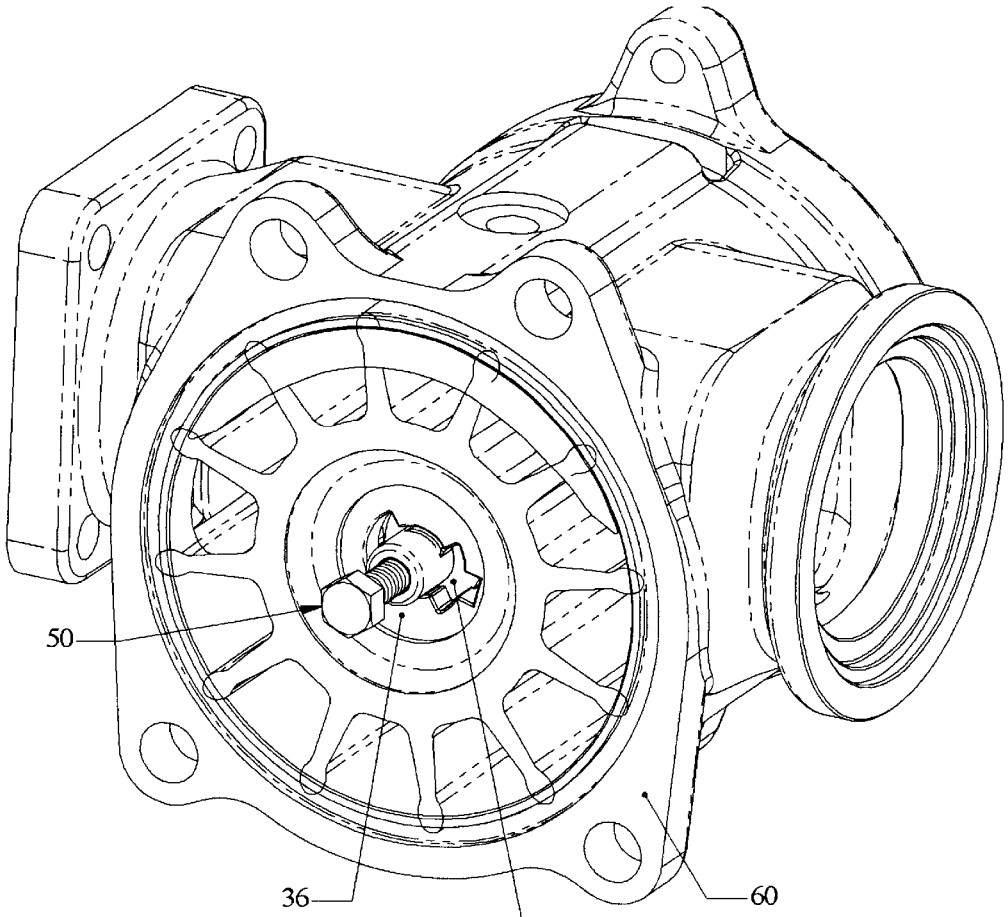
FIG. 11 is a perspective view of the use of the alternative removal tool.

In a second embodiment, as shown in FIG. 9, a removal tool 50 can be applied to the same rubber impeller insert 30. In the second embodiment the locking spade mechanism 54, has a female threaded aperture 56. The female threads are engaged by bolt 52 having male threads 58. The removal tool 50 has flanges 55 on the spade lock 54 is inserted into the slots 33 on removal lugs 35 and turned to the stops 34 in the exact same manner as the above removal tool 40 as shown in FIG. 8. The spade lock 54 is prevented from rotating after hitting the two stops 34 of the impeller insert 30. The bolt 52 is then turned to jack screw the impeller insert 30 from the pump shaft 90 as in FIG. 11.

Figure 12:
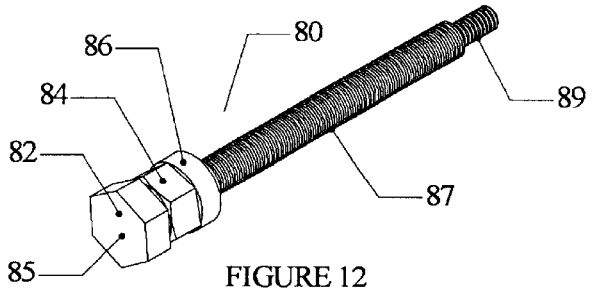
FIG. 12 is a perspective view of the installation tool.
Figure 13:
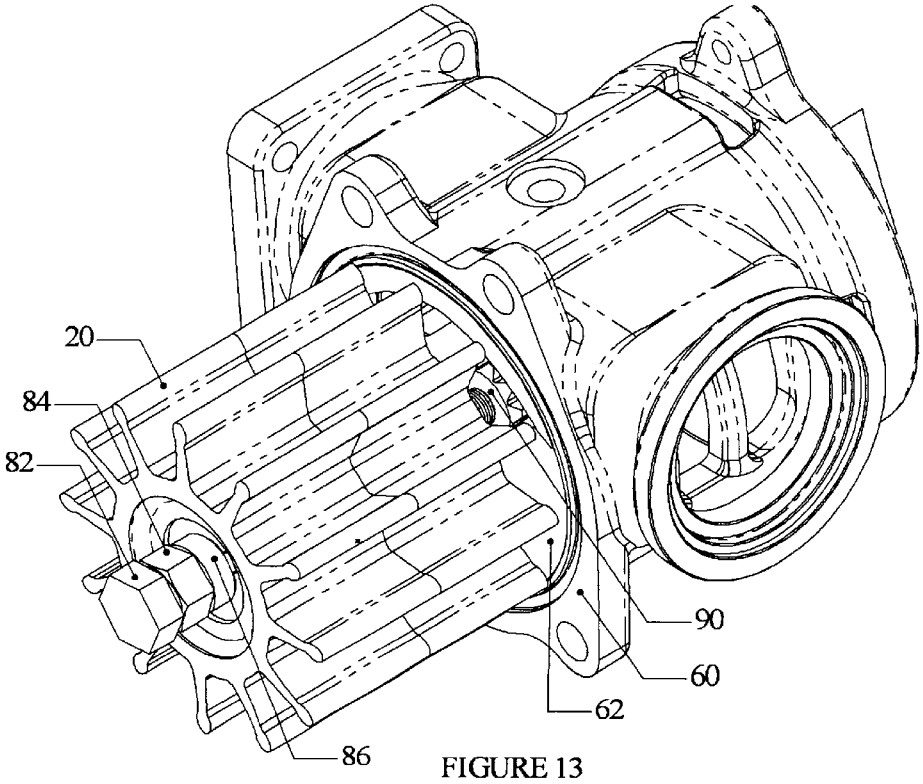
FIG. 13 is a perspective view of the installation tool being used to install an impeller.
Figure 14:
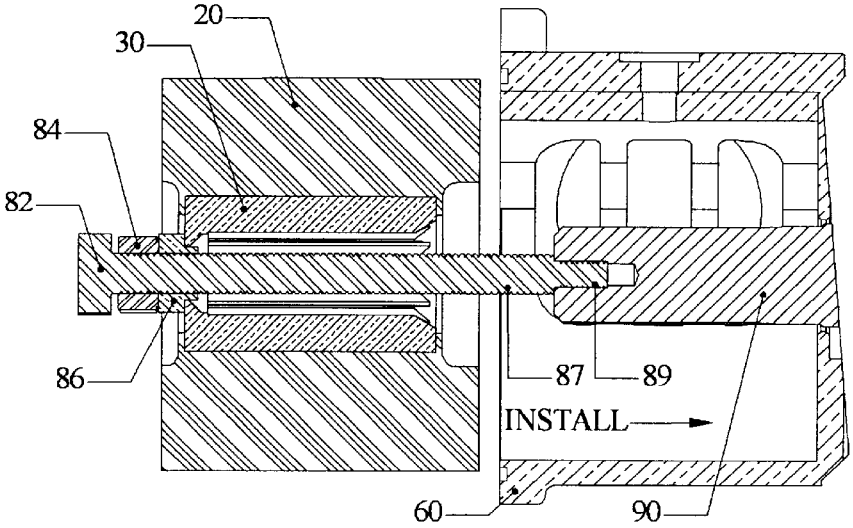
FIG. 14 is a cross sectional view showing the use of the installation tool.
Figure 15:
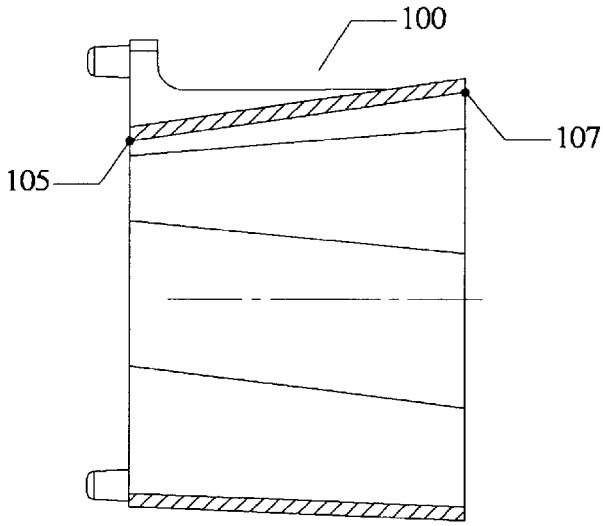
FIG. 15 is a perspective view of the alignment cone used to assist impeller installation.
Figure 16:
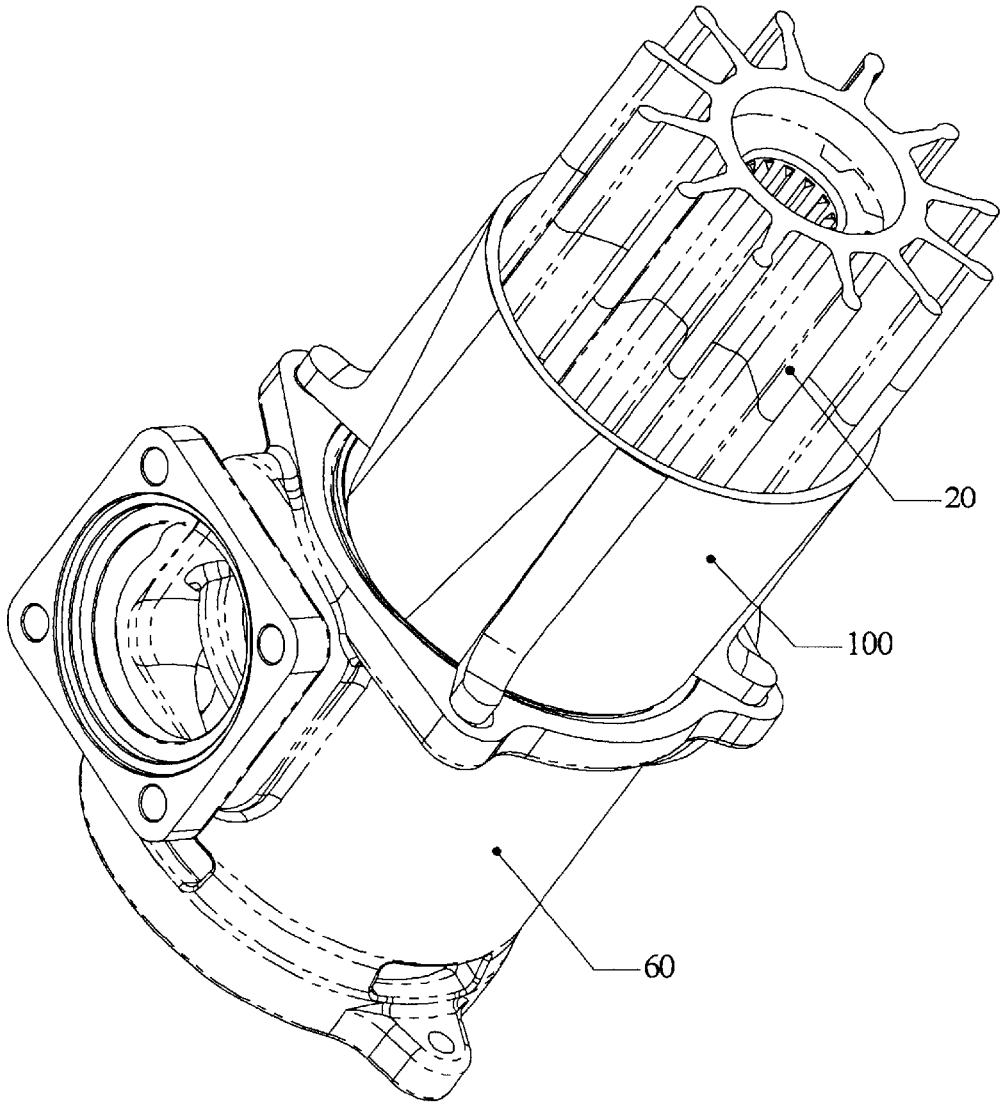
FIG. 16 is a perspective view of the alignment cone in installing an impeller.

An installation tool 80 is shown in FIG. 12. It comprises of a bolt 82 with two different stepped threads 87 and 89 of different diameters, a nut 84 and a large washer 86. FIGS. 13, 14 show the method of installing the impeller 20 using installation tool 80. The nut 84 is threaded until it is almost to the bolt head 85. A washer 86 is placed on the bolt 82 just below the nut 84 and then the impeller insert 30 is slid on the bolt 82. The assembly of the impeller insert 30 on the installation tool 80 is then threaded into the end of the pump shaft 90. Then the impeller insert 20 is forced into the pump housing 60 by turning the nut 84 on the bolt 82. Impeller installation can be further assisted by use of an alignment cone 100 as shown in FIG. 15. The alignment cone 100 is placed over the front of the open pump housing 60. One side 105 of the alignment cone 100 matches the contour of the pump bore 62 in the pump housing 60. The other side 107 starts at a diameter slightly larger than the impeller 20. The alignment cone 100 can be made of thin plastic from a mold. The plastic selected can be of a lubricating variety with a low coefficient of friction between the rubber blades of the impeller 20 and the alignment cone 100. As the impeller 30 is force through the alignment cone 100 the impeller blades are gradually bent to conform to the shape of the pump bore 62. FIG. 16 shows the use of the alignment cone 100 with an impeller 20. The installation tool 80 and the alignment cone 100 may each be used either independently or together to gain the combined benefits of each. For mid sized impellers it may only be necessary to use only one helping mechanism depending on the circumstances. For particularly large impellers both the alignment cone 100 and the installation tool 80 may be required for installation. Another variation of the alignment cone 100 is to prepackage the impeller 30 in a thin plastic tube preformed to the dimensions required. The user would only have to place the package over the pump and push the impeller from the alignment tube 100 into the pump housing 60.

In one embodiment of the invention the end piece 32 is a single ear or flange 36 attached to the impeller insert 30. The stops 34 may be on the impeller insert 30 or on the end piece 32. There is a space between the ear 36 and the impeller insert 30 so that the removal tools 40 or 50 can be inserted through slots 33 to engage the ear 36 from the back side thereof for pulling the impeller insert 30 from the pump shaft 90.

Alternatively the end piece 32 can have two ears or flanges attached to the impeller insert 30, an outer ear 36 and an inner ear 38 with stops 34 extending therebetween. The outer and inner ears 36, 38 define a space for the insertion of the removal tools 40 or 50. The outer and inner ears 36,

38 may be on one bronze insert attached to the impeller insert 30 or may be separate parts-one or both having stops 34 attached.

Obviously, many modifications and variations of the present invention are possible in light of the above teachings. It is therefore to be understood that, within the scope of the appended claims, the invention may be practiced otherwise than as specifically described.

What is claimed is:

1. An impeller insert having an end piece comprising:

a cylinder having a central shaft bore portion with a drive mechanism for connecting the impeller to a shaft, an outer ear attached to the impeller insert, for capping a space, between at least a portion of the impeller insert and the outer ear, at least one slot in the outer ear for the insertion of a portion of a removal tool into the space, an outer cylindrical surface for attaching an impeller.

2. An impeller insert having an end piece as in claim 1 wherein:

and at least one stop in the space between the outer ear and the impeller to prevent the removal tool from freely rotating therein.

3. An impeller insert having an end piece as in claim 1 wherein:

an impeller removal tool having engagement flanges for insertion in the slot of the outer ear, such that the engagement flanges can pull on the outer ear to remove the impeller from a pump housing.

4. An impeller insert having an end piece as in claim 2 wherein:

an impeller removal tool having engagement flanges for insertion in the slot of the outer ear, such that the engagement flanges can be rotated to engage a portion of the outer ear and pull thereon to remove the impeller from a pump housing.

5. An impeller insert having an end piece as in claim 3 wherein:

the removal tool has a handle for leveraging the tool and applying force to the impeller to remove it from the pump housing.

6. An impeller insert having an end piece as in claim 5 wherein:

the removal tool has a prying slot therein for use with a prying tool to leverage the tool and aid in the removal of the impeller it from the pump housing.

7. An impeller insert having an end piece as in claim 3 wherein:

the removal tool has a treaded shaft and a body with flanges and a threaded central bore such that the threaded shaft can be turned and pushed against a pump shaft to jack screw the impeller out of the pump housing.

8. An impeller insert having an end piece as in claim 1 wherein:

the drive mechanism has splines to engage the impeller insert to a pump shaft.

9. An impeller insert having an end piece as in claim 1 wherein:

the drive mechanism has a key to engage the impeller insert to a pump shaft.

10. An impeller insert having an end piece as in claim 1 wherein:

an insertion tool extends through the central shaft bore of the impeller insert, the insertion tool having at least one threaded portion, a nut on one threaded portion and a washer adjacent the nut, at least one threaded portion of the insertion tool threaded into a pump shaft for attachment thereto, such that when the nut is rotated on the insertion tool it will press on the washer and force the impeller insert onto the pump shaft.

11. An impeller insert having an end piece as in claim 10 wherein:

an alignment cone having a bore with a decreasing diameter attached to a pump housing guides the impeller into the pump housing and onto the pump shaft.

* * * * *